US006192974B1

(12) United States Patent
Boedecker

(10) Patent No.: US 6,192,974 B1
(45) Date of Patent: Feb. 27, 2001

(54) HEAT EXCHANGER HOUSING HAVING CONICAL INLET AND OUTLET GAS TRANSITIONS

(75) Inventor: Paul L. Boedecker, Excelsior, MN (US)

(73) Assignee: Xchanger, Inc., Hopkins, MN (US)

( * ) Notice: Subject to any disclaimer, the term of this patent is extended or adjusted under 35 U.S.C. 154(b) by 0 days.

(21) Appl. No.: 09/153,615

(22) Filed: Sep. 15, 1998

(51) Int. Cl.[7] ..... F28F 3/00
(52) U.S. Cl. ..... 165/165; 165/157; 165/163
(58) Field of Search ..... 165/157, 159, 165/163, 166, 165

(56) References Cited

U.S. PATENT DOCUMENTS 4,083,400 * 4/1978 Dziedzic et al. ..... 165/165

OTHER PUBLICATIONS

Company Brochure, "Xchanger, Inc.: Heat Exchangers, Standard Designs, Custom Designs, Since 1972", *Xchanger, Inc.*, pp. 1–9 (1994).

* cited by examiner

*Primary Examiner*—Ira S. Lazarus
*Assistant Examiner*—Terrell McKinnon
(74) *Attorney, Agent, or Firm*—Merchant & Gould P.C.

(57) ABSTRACT

A heat exchanger housing containing a filmed heat exchanger coil, the heat exchanger used to either heat or cool gases, and materials suspended in the gases, as they pass through the housing. The heat exchanger housing includes a substantially rectangular body, such as a square body. On the exterior of the heat exchanger housing is placed an inlet and an outlet. In specific implementations, the inlet and the outlet are positioned on opposite sides of the rectangular body. The inlet and outlet are each substantially circular. Joined to the substantially circular inlet and outlet are conical transitions that join to circular carrier lines. The carrier lines direct gases toward or away from the heat exchanger housing. Conical transitions provide a way to direct the gases from the circular carrier lines into the exchanger housing with a minimum of difficulty, with increased efficiency, and with avoidance of problems from metal fatigue at the corners of traditional transitions.

17 Claims, 3 Drawing Sheets

HEAT EXCHANGER HOUSING HAVING CONICAL INLET AND OUTLET GAS TRANSITIONS

FIELD OF THE INVENTION

The present invention relates generally to heat exchangers. More specifically, the present invention relates to transition members forming the inlets and outlets to rectangular heat exchanger housings which contain finned heat exchanger coils.

BACKGROUND OF THE INVENTION

Heat exchangers designed for cooling and heating gases at pressures less than 3 atmospheres are widely used and well suited to finned heat exchanger coils. Such heat exchangers are used, for example, to cool gases used to carry grains into or out of storage bins, grain elevators, and rail cars. If the gases are not at the proper temperature, molding can occur, as can other problems associated with temperature and pressure.

Traditionally, many finned heat exchanger coils and housings for such applications have been rectangular in cross section, and nearly all pressurized gas flows into and out of the housing through gas carrier lines that have a round cross section. Industry practice has been to build heat exchanger housings that have square-to-round transitions in order to direct gases from the round carrier lines into the rectangular exchanger housing body.

The square-to-round transitions traditionally used have a first end that is generally square or rectangular and a second end that is generally round. This square or rectangular end of the transition has four distinct sides, plus four corners, and fastens to the rectangular housing. These four sides usually gradually round off to a circle at the second end of the transition. This circular second end connects to the circular gas carrier line.

Unfortunately, these existing square-to-round transitions used in such heat exchanger systems are problematic because they suffer from a number of draw backs. In particular, the four flat areas must be sufficiently thick and strong enough to avoid deformation and deflection when under pressure. Alternatively the flat areas must be reinforced in order to maintain the shape of the transition member within proper tolerances. If these flat areas display two much deflection, undue stress is transferred to the corners of the transitions, which suffer metal fatigue and fail.

Not only are these square-to-round transitions troublesome due to the fact that they are prone to failure if not constructed of sufficiently strong materials, they are also relatively difficult to make due to the fact that multiple bends must be made and reinforcing strips must be installed. These bends can add cost to the manufacture of the transition members because they require additional labor, and the reinforcing strips add cost by requiring additional material as well as additional labor.

Therefore, a need exists for an improved heat exchanger housing and transition that overcomes the aforementioned problems associated with present housings and transitions.

SUMMARY OF THE INVENTION

The present invention is directed to a heat exchanger housing containing a finned heat exchanger coil. The heat exchangers of the present invention are used to heat or cool gases as they pass through the housing. In certain implementations, the finned heat exchanger coil carries a cold fluid that cools the gases as they pass through the housing. In other implementations, the finned heat exchanger coil carries a hot fluid that heats the gases as they pass through the housing.

In certain implementations of the invention, the heat exchanger housing includes a substantially rectangular body. On the exterior of the heat exchanger housing is placed an inlet and an outlet. In specific implementations, the inlet and the outlet are positioned on opposite sides of the rectangular body. The inlet and outlet are each substantially circular. Joined to these substantially circular inlets and outlets are conical transition portions that join to circular carrier lines. The carrier lines direct gases toward or away from the heat exchanger housing. Conical transitions provide a way to direct the gases from the circular carrier lines into the rectangular exchanger housing with a minimum of difficulty and with increased efficiency. Problems from metal fatigue at the corners, as used by prior art transfer members, are also avoided.

In certain embodiments, the housing of the heat exchanger has first and second generally planar metallic walls. Both of these walls are substantially rectangular, and are positioned parallel to one another at opposite sides of the housing. The first and second walls each contain a substantially circular opening to which is connected a conical transition member. The openings are substantially opposite one another. A first conical metallic transition member is connected to the first circular opening in the first wall. This conical transition member tapers from the circular opening to a narrowed end distal from the first wall of the housing. In addition, a second conical metallic transition member is connected to the second substantially circular opening in the second wall. The second conical transition member tapers to a smaller circle distal from the second wall.

Unlike prior art transitions used for low-pressure applications to connect a round carrier line to a square or rectangular housing, the conical transition members of the present invention do not contain corners or creases. The lack of such corners and creases increases the strength of the transition members. In addition, the conical transition members lack planar or flat portions. Therefore, without these flat surfaces, the conical transition members undergo less deformation under pressure.

In certain implementations of the invention, third and fourth substantially planar rectangular walls are provided on the exchanger housing. The third and forth walls are positioned perpendicular to and intermediate the first and second walls, thereby defining a four-sided rectangular arrangement having a rectangular front edge and an opposite rectangular rear edge, the four-sided rectangular arrangement has an interior intermediate the walls of the arrangement.

A front flange and a rear flange are secured to, or integrally formed with, the rectangular arrangement. The front flange is proximate the front edge of the rectangular arrangement and the rear flange is proximate the rear edge of the rectangular arrangement. The front and rear flanges each include a protruding lip extending from the sides of the rectangular arrangement away from the interior. Each protruding lip contains a plurality of openings configured to receive a fastener.

Additionally, in certain embodiments, a front cover plate is joined to the front flange of the rectangular arrangement and a rear cover plate is joined to the rear flange of the rectangular arrangement. A finned heat exchanger coil is positioned within the heat exchanger housing, the finned heat exchanger coil preferably having a substantially rectangular cross section.

The above summary of the present invention is not intended to describe each disclosed embodiment of the present invention. This is the purpose of the figures and the detailed description which follow.

BRIEF DESCRIPTION OF THE DRAWINGS

Other aspects and advantages of the invention will become apparent upon reading the following detailed description and upon reference to the drawings in which.

Figure 1:
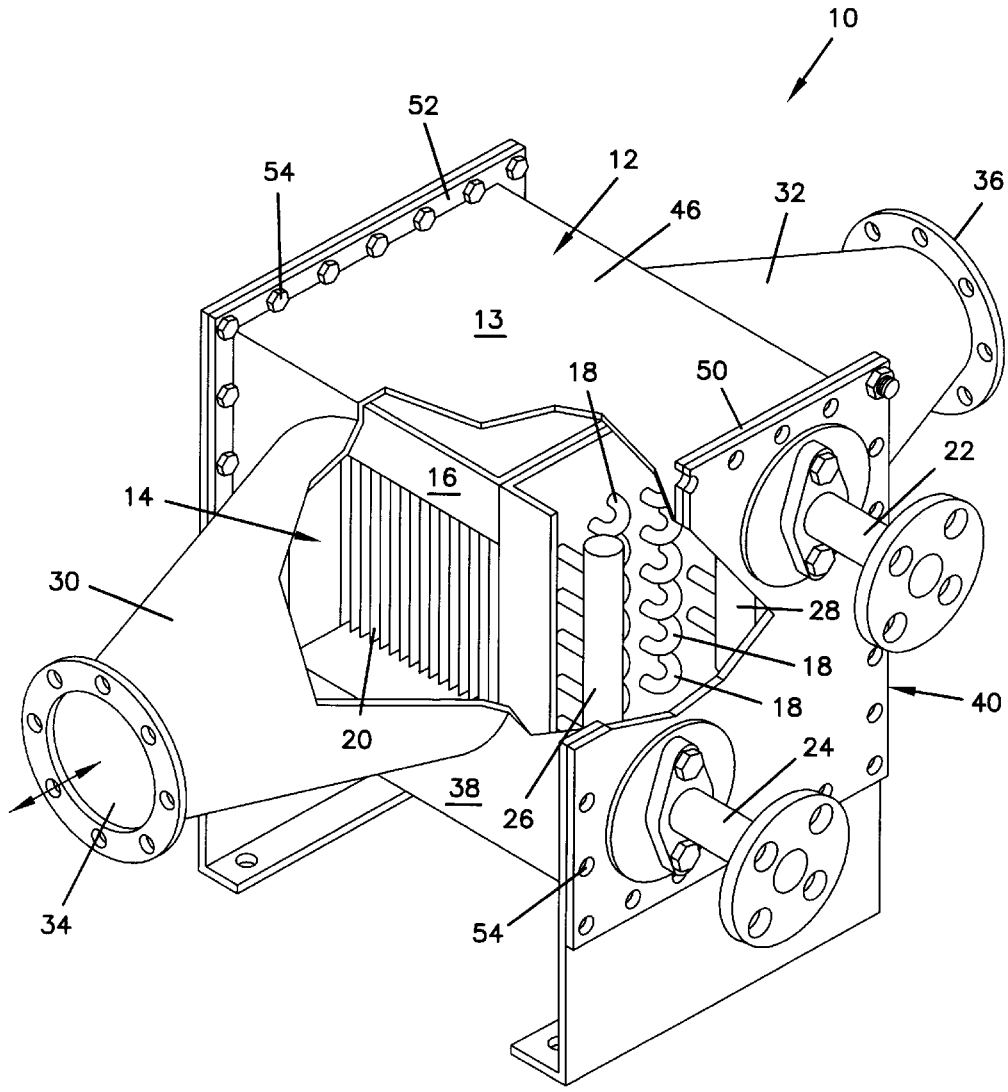
FIG. 1 is a perspective view of a heat exchanger system constructed in accordance with the present invention, showing portions of the housing removed.

While the invention is susceptible to various modifications and alternative forms, specifics thereof have been shown by way of example in the drawings and will be described in detail. It should be understood, however, that the intention is not to limit the invention to the particular embodiment described. On the contrary, the intention is to cover all modifications, equivalents, and alternatives falling within the spirit and scope of the invention as defined by the appended claims.

DETAILED DESCRIPTION

The present invention is directed to a heat exchanger housing. The housing contains a finned heat exchanger coil suitable for use in cooling or heating gases passing through the exchanger at pressures approximately 3 atmospheres and below. The heat exchanger heats or cools gases as they pass through the housing. In certain implementations, the finned heat exchanger coil carries a cold fluid which cools the gases. In other implementations, the finned heat exchanger coil carries a hot fluid which warms the gases as they pass through the housing. In addition to heating or cooling the gases passing through the housing, changes in humidity and moisture content can also occur, which can make the gases more suitable for specific applications.

Referring now to the attached figures, in which the same numerals represent the same features throughout the figures, FIG. 1 shows a heat exchanger system 10 constructed and arranged in accordance with the present invention. System 10 includes a housing 12 and a coil 14 (shown, in part, in the portion of the housing that has been removed to demonstrate location of the coil). The coil 14 is contained within a casing 16. The casing 16 partially surrounds a plurality of tubes 18. These tubes 18 hold a cooling or heating fluid. The tubes 18 penetrate, and are surrounded by, a multitude of fins 20. These fins 20 are cooled (or heated) by the tubes 18 that contain the cooling or heating fluid. These fins 20 are preferably manufactured of a thin, highly conductive metal. During operation, the gas to be cooled (or heated) passes through the fins 20 and is rapidly cooled (or heated).

In the implementation depicted, the cooling fluid is delivered to the coil 14 by way of a pair of hubs 22, 24, which carry the fluid either into or out of the coil 14. The hubs 22, 24 are connected to headers 26, 28 (shown in part) that each join to numerous tubes 18 in the coil 14. In this fashion, the cooling or heating liquid is quickly and efficiently delivered to the coils 14 so as to cool the fins 20 as rapidly as possible and effectuate a quick and efficient change in temperature of the gas passing through the housing 12 of the system 10.

Also shown in FIG. 1 are two transition members 30, 32. Transition members 30, 32 serve to direct gases from carrier lines (not shown) into the rectangular housing 12 of the heat exchanger system 10. The transition members 30, 32 permit the gases to expand from a relatively narrow diameter at the start of the transition to a relatively broad diameter proximate the rectangular housing 12. This expansion diminishes the gas velocity flow resistance.

Figure 2:
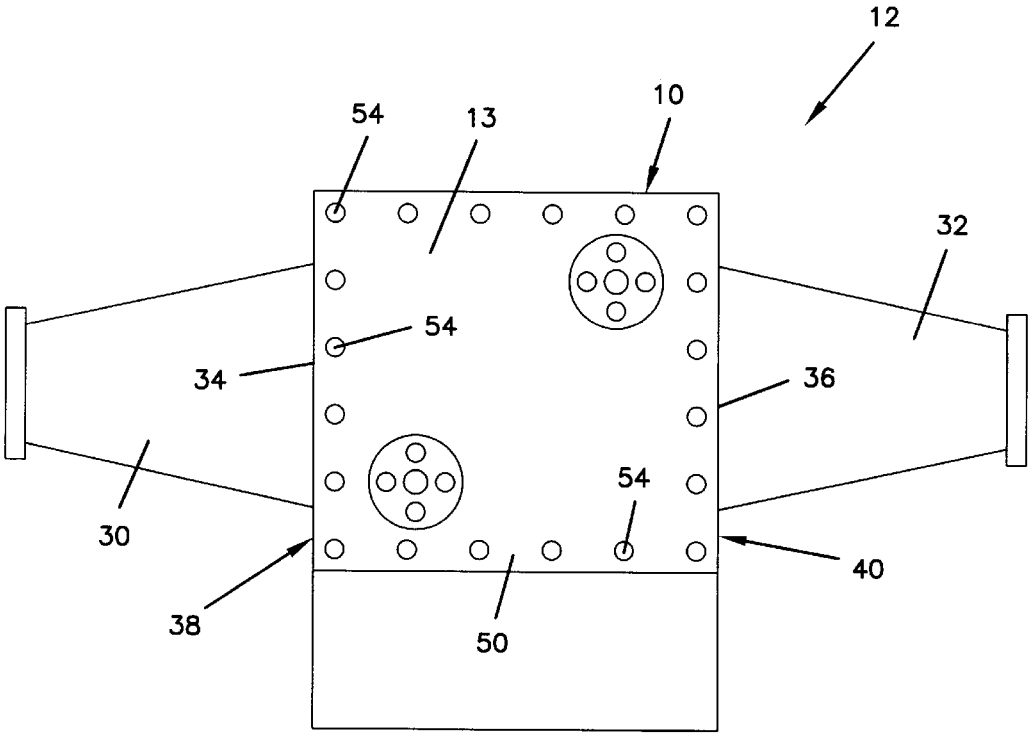
FIG. 2 a front elevational view of a heat exchanger housing constructed in accordance with the present invention.
Figure 3A:
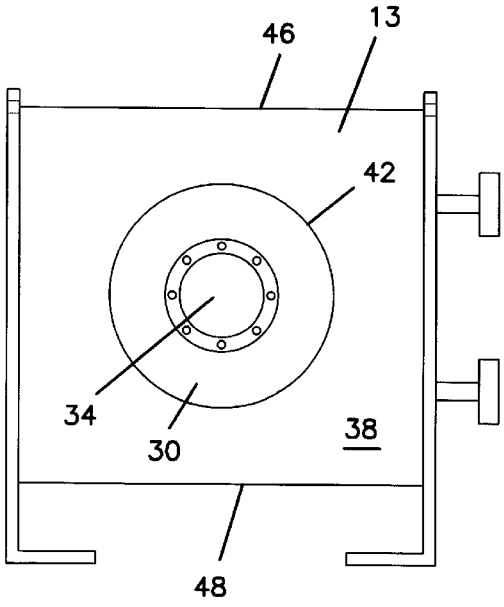
FIG. 3A is a side elevational view a heat exchanger housing constructed in accordance with the present invention.
Figure 3B:
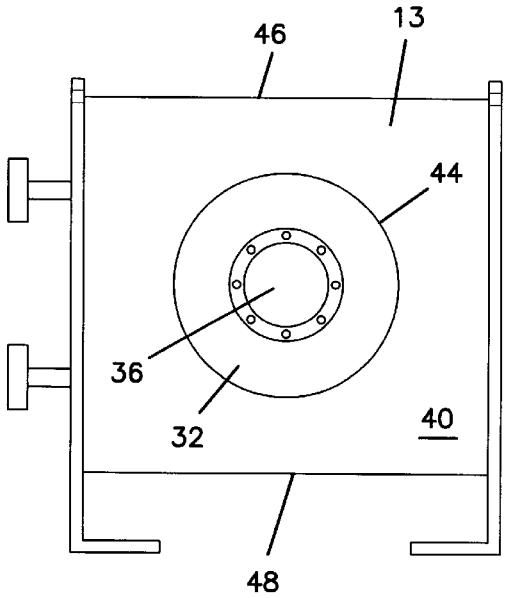
FIG. 3B is a side elevational view a heat exchanger housing constructed in accordance with the present invention, showing a side opposite to that shown in FIG. 3A.

In reference now also to FIGS. 2, 3A and 3B, the housing 10 is shown in a frontal elevational view and a side elevational view, respectively. As is evident from the three figures, the housing includes a substantially rectangular body 13. On the exterior of the housing 12 are positioned circular openings that serves as an inlet 34 and an outlet 36 to transition members. In specific implementations, the inlet and outlet 34, 36 are positioned on opposite sides of the rectangular body 13. The inlet 34 and outlet 36 are each substantially circular. The conical transitions 30, 32 provide a way to direct the gases from circular carrier tubes (not shown) into the exchanger housing 12 with a minimum of difficulty and increased efficiency.

The heat exchanger housing 12 is configured to receive the finned heat exchanger coil 14 positioned within the heat exchanger housing 10, and the finned heat exchanger coil 14 preferably has a substantially rectangular cross section.

The conical transition members 30, 32 and the rectangular body 13 of the housing 12 are preferably constructed of metal, including aluminum and steel. The metal is preferably sheet metal. A metal thickness of 0.03 to 0.5 inches is preferred, and 0.07 to 0.375 inches is more preferred.

In certain embodiments, the body 10 of the heat exchanger system 12 has a first generally planar metallic wall 38, and second generally planar metallic wall 40 (See FIGS. 2, 3A, and 3B). Both of the walls 38, 40 are substantially rectangular, and are positioned parallel to one another. The first and second walls 38, 40 each contain a substantially circular opening 42, 44. The openings 42, 44 are also substantially opposite one another. The conical metallic transition member 30 is connected to the first circular opening 42 in the first wall 38. This conical transition member 30 tapers from the circular opening 42 in the first wall 38 to inlet 34 at a narrowed end distal from the first wall 38. In addition, a second conical metallic transition member 32 is connected to the second substantially circular opening 44 in the second wall 40. The second conical transition member 32 tapers into an outlet 36 distal from the second wall 41.

In certain implementations of the invention, third and fourth substantially planar rectangular walls are provided. The third and fourth walls 46, 48 are positioned perpendicular and intermediate the first and second walls to define a four-sided rectangular arrangement having a rectangular front edge and an opposite rectangular rear edge, the four-sided rectangular arrangement defining an interior intermediate the walls.

A front flange 50 and a rear flange 52 are secured to the rectangular arrangement (See FIG. 1). The front flange 50 is proximate the front edge of the rectangular arrangement and the rear flange 52 is proximate the rear edge of the rectangular arrangement. The front and rear flanges 50, 52 each include a protruding lip extending from the sides of the rectangular arrangement away from the interior. Each protruding lip contains a plurality of openings 54 configured to receive a fastener.

The first and second conical transition members each have a single longitudinal seam. This single seam is much easier to produce than the prior art square-to-round transitions that often required two, and even four, scams. The decrease in seam numbers allows for increased savings in labor costs to manufacture the transition members as well as increased strength.

In a particular implementation, the first wall 38 has a surface area of a first quantity. The cross sectional surface area enclosed by the perimeter of a heat exchange coil 14 positioned within the housing 10 is greater than or equal to 75 percent of the first quantity. The ratio of the diameter of the conical transition members proximate the openings 42, 44 in the first and second walls 38, 40 to the length of the conical transitions is less than or equal to 1.0. In a certain implementation, the circular diameter of the conical transition is between 6 and 100 inches at the opening 42 of the first wall 38 and is between 2 and 40 inches at the inlet 34 distal from the first wall 38.

During use, gaseous materials preferably pass through the heat exchanger housing at a pressure less than 5 atmospheres, and more preferably less than 3 atmospheres. In certain embodiments, gaseous materials pass at a pressure less than 1.5 atmospheres.

Specific implementations include a surface area of the first circular opening 42 in the wall 38 between 25 and 7500 square inches. The surface area of the first circular opening distal from the first wall 38 is between 3 and 1250 square inches. The housing also optionally includes an opening for insertion and removal of a heat exchange coil along the front.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

I claim:

1. A heat exchanger housing for enclosing a finned heat exchanger, the housing comprising:

first aid second generally planar metallic walls, each of the walls being substantially rectangular, the walls positioned parallel to each other;

a first substantially circular opening in the first wall, and a second substantially circular opening in the second wall, the first and second openings substantially opposite one another, wherein the first circular opening has a first circular diameter and the second circular opening has a second circular diameter;

a first conical metallic transition member connected to the first substantially circular opening in the first wall, wherein the first conical transition member tapers from the first circular diameter proximate the first wall to a smaller circular diameter distal from the first wall;

a second conical metallic transition member connected to the second substantially circular opening in the first wall, wherein the second conical transition member tapers from the second circular diameter proximate the second wall to a smaller circular diameter distal from the second wall; and a heat exchanger coil positioned within the housing.

2. The heat exchanger housing according to claim 1, further comprising a finned heat exchanger coil positioned within the heat exchanger housing, the finned heat exchanger coil having a substantially rectangular cross section.

3. The heat exchanger housing according to claim 1, wherein the first and second conical transition members have a metal thickness of 0.07 to 0.375 inches.

4. The heat exchanger housing according to claim 1, further comprising:

third and fourth substantially planar rectangular walls, the third and forth walls positioned perpendicular and intermediate the first and second walls to define a four-sided rectangular arrangement having a rectangular front edge and an opposite rectangular rear edge, the four-sided rectangular arrangement having an interior intermediate the walls;

a front flange and a rear flange, the front flange proximate the front edge of the rectangular arrangement and the rear flange proximate the rear edge of the rectangular arrangement, the front and rear flanges each comprising a protruding lip extending from the sides of the rectangular arrangement away from the interior, each protruding lip containing a plurality of openings each configured to receive a fastener; and a front cover plate joined to the front of the rectangular arrangement and a rear cover plate joined to the rear flange of the rectangular arrangement.

5. The heat exchanger housing according to claim 1, wherein the first and second conical transition members each have a single longitudinal seam.

6. The heat exchanger housing according to claim 1, further comprising a flange on a rear edge of each of the first and second walls, the flange configured and arranged to receive a planar rear plate joining the first and second sides.

7. The heat exchanger housing according to claim 1, wherein the first wall has a surface area of a first quantity, and the cross sectional surface area enclosed by the perimeter of a heat exchange coil positioned within the housing is greater than or equal to 75 percent of the first value.

8. The heat exchanger housing according to claim 1, wherein the ratio of the diameter of the conical transition members proximate the first and second walls to the length of the conical transitions is less than or equal to 1.0.

9. The heat exchanger housing according to claim 1, wherein the first circular diameter of the first conical transition is between 6 and 100 inches proximate the first wall and is between 2 and 40 inches distal from the first wall.

10. The heat exchanger housing according to claim 1, wherein during use gaseous materials pass through the heat exchanger housing at a pressure less than 3 atmospheres.

11. The heat exchanger housing according to claim 1, wherein during use gaseous materials pass through the heat exchanger housing at a pressure less than 1.5 atmospheres.

12. The heat exchanger housing according to claim 1, wherein the surface area of the first circular opening proximate the first wall is between 25 and 7500 square inches, and the surface area of the first circular opening distal from the first wall is between 3 and 1250 square inches.

13. The heat exchanger housing according to claim 1, further comprising an opening for insertion and removal of a heat exchange coil.

14. A heat exchanger housing for enclosing a finned heat exchanger configured to carry gaseous materials at a pressure less than 3 atmospheres, the housing comprising:

first and second generally planar metallic walls, each of the walls being substantially rectangular, the walls positioned parallel to each other;

a first substantially circular opening in the first wall, and a second substantially circular opening in the second wall, the first and second openings substantially opposite one another, wherein the first circular opening has a first circular diameter and the second circular opening has a second circular diameter;

a first conical metallic transition member connected to the first substantially circular opening in the first wall, wherein the first conical transition member tapers from the first circular diameter proximate the first wall to a smaller circular diameter distal from the first wall;

a second conical metallic transition member connected to the second substantially circular opening in the first wall, wherein the second conical transition member tapers from the second circular diameter proximate the second wall to a smaller circular diameter distal from the second wall;

third and fourth substantially planar rectangular walls, the third and forth walls positioned perpendicular and intermediate the first and second walls to define a four-sided rectangular arrangement having a rectangular front edge and an opposite rectangular rear edge, the four-sided rectangular arrangement having an interior intermediate the walls;

a front flange and a rear flange, the front flange proximate the front edge of the rectangular arrangement and the rear flange proximate the rear edge of the rectangular arrangement, the front and rear flanges each comprising a protruding lip extending from the sides of the rectangular arrangement away from the interior, each protruding lip containing a plurality of openings each configured to receive a fastener; and a front cover plate joined to the front of the rectangular arrangement and a rear cover plate joined to the rear flange of the rectangular arrangement;

a finned heat exchanger coil positioned within the heat exchanger housing, the finned heat exchanger coil having a substantially rectangular cross section.

15. The heat exchanger housing according to claim 14, wherein the first wall has a surface area of a first quantity, and the cross sectional surface area enclosed by the perimeter of a heat exchange coil positioned within the housing is greater than or equal to 75 percent of the first value; and the first circular diameter of the first conical transition is between 6 and 100 inches proximate the first wall and is between 2 and 40 inches distal from the first wall.

16. The heat exchanger housing according to claim 14, wherein the ratio of the diameter of the conical transition members proximate the first and second walls to the length of the conical transitions is less than or equal to 1.0.

17. The heat exchanger housing according to claim 14, further comprising an opening for insertion and removal of a heat exchange coil.

* * * * *

UNITED STATES PATENT AND TRADEMARK OFFICE

CERTIFICATE OF CORRECTION

PATENT NO. : 6,192,974 B1
DATED : February 27, 2001
INVENTOR(S) : Boedecker

It is certified that error appears in the above-identified patent and that said Letters Patent is hereby corrected as shown below:

Title page,
Item [57], ABSTRACT, line 1, "filmed" should read -- finned --

Signed and Sealed this

Seventh Day of May, 2002

*Attest:*

*Attesting Officer*

JAMES E. ROGAN
*Director of the United States Patent and Trademark Office*